United States Patent [19]

Goldfarb et al.

[11] 4,119,319

[45] Oct. 10, 1978

[54] ELECTRICAL BOARD GAME APPARATUS

[76] Inventors: Adolph E. Goldfarb, 4614 Monarca Dr., Tarzana, Calif. 91356; Erwin Benkoe, 17965 Medley Dr., Encino, Calif. 91316

[21] Appl. No.: 757,216

[22] Filed: Jan. 6, 1977

[30] Foreign Application Priority Data

Jan. 8, 1976 [GB] United Kingdom ..... 00593/76

[51] Int. Cl.[2] ..... A63F 3/00

[52] U.S. Cl. ..... 273/237; 273/248

[58] Field of Search ..... 273/134 A, 134 G, 134 GB, 273/134 AD, 130 AB, 131 A, 136 A, 135 A, 1 E, 134 GA, 237

[56] References Cited

U.S. PATENT DOCUMENTS

| | | | |
|---|---|---|---|
| 2,244,015 | 6/1941 | MacKinnon | 273/134 A |
| 3,563,552 | 2/1971 | Korff | 273/134 A |
| 3,825,266 | 7/1974 | Bissell | 273/130 AB |
| 3,860,241 | 1/1975 | Leftin | 273/134 A |
| 4,036,500 | 7/1977 | Kiernan | 273/130 AB |

FOREIGN PATENT DOCUMENTS

| | | | |
|---|---|---|---|
| 747,794 | 12/1966 | Canada | 273/1 E |

*Primary Examiner*—Richard C. Pinkham
*Assistant Examiner*—Harry G. Strappello
*Attorney, Agent, or Firm*—Robert M. Ashen; Robert J. Schaap

[57] ABSTRACT

Apparatus for playing a game comprising a game board having a playing area comprising a plurality of playing positions arranged in regular array, and sets of opposed playing pieces adapted to be moved within the playing area on the playing positions. The playing area including opposed starting/finishing positions and including indicating devices which are adapted, upon actuation of operating controls connected thereto, to indicate whether a playing piece may move within the playing area. The apparatus also includes a determining device to determine the number of playing positions to be moved by a playing piece.

6 Claims, 6 Drawing Figures

ELECTRICAL BOARD GAME APPARATUS

In order that the invention may be more readily understood, an embodiment thereof will now be described, by way of example, reference being made to the accompanying drawings, in which.

Figure 1:
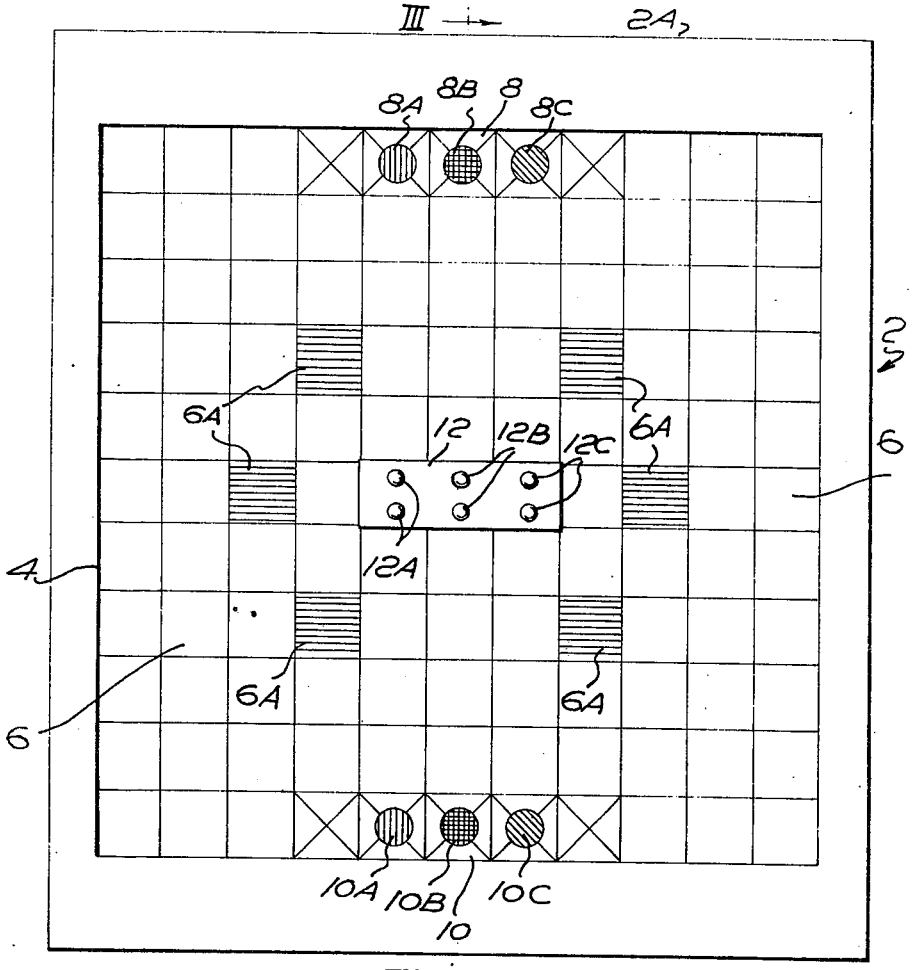
FIG. 1 is a plan view of a game board forming part of the apparatus of the invention.

Referring to the drawing, and firstly to FIG. 1, a game board 2 has a playing area 4 which comprises a plurality of playing positions 6 arranged in regular array within said playing area 4. As will be seen, the playing area includes at two opposed sides thereof starting/finishing areas 8 and 10, each area comprising of five playing positions or base squares which are coloured differently to the playing positions 6. The centre there positions of the starting/finishing areas each carry a coloured spot or similar marking, the purpose of which will be explained later. These spots are marked 8A, 8B and 8C and 10A, 10B and 10C respectively and are coloured respectively green, yellow and red. The six playing positions referenced 6A are also of a different colour to the remaining playing positions 6, and again the purpose of these positions 6A will be explained later.

At the centre of the playing area 6 is an area 12 which carries six coloured and transparent or translucent members 12A, 12B and 12C coloured red, yellow and green respectively.

The members 12A, 12B and 12C are preferably composed of a synthetic plastics material, located in vertically-disposed through-bores in the area 12.

Figure 2:
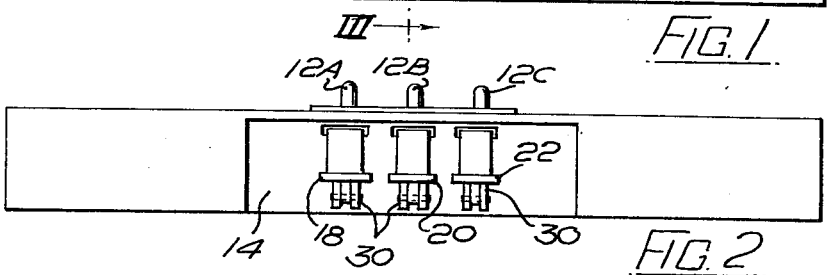
FIG. 2 is an end elevation of the game board of FIG. 1.
Figure 3:
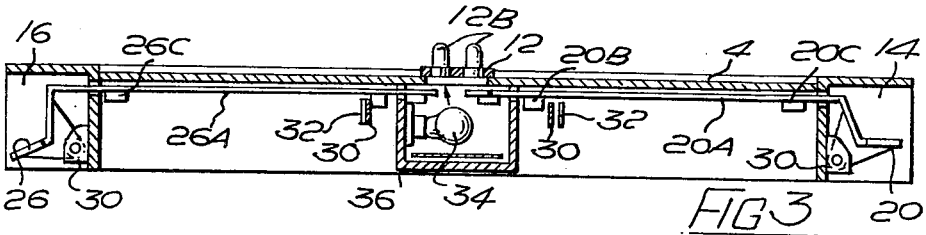
FIG. 3 is a sectional side elevation taken along the line III—III of FIG. 1.
Figure 4:
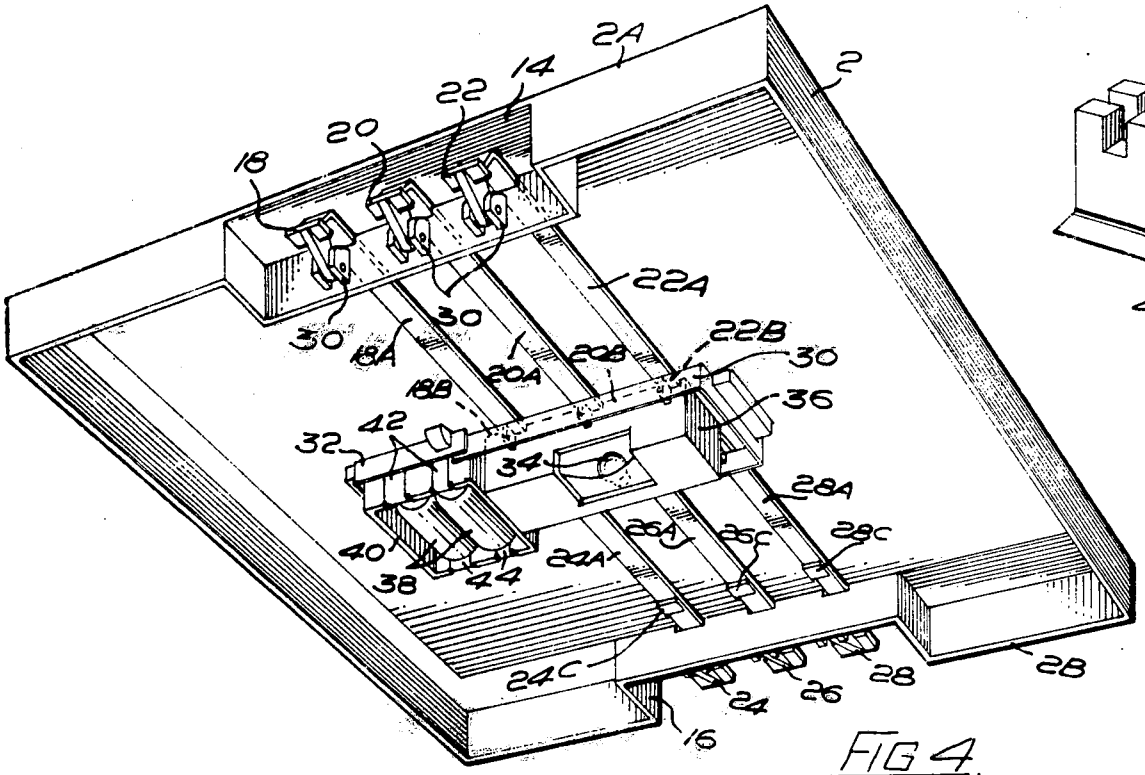
FIG. 4 is an underneath perspective plan view of the game board of FIGS. 1 to 3.

As will be seen from FIGS. 2, 3 and 4 the game board 2 is a box-like member and in two opposing sides 2A and 2B there is a recess 14 and 16 respectively. Located in these recesses are levers 18, 20, 22 and 24, 26 and 28, which are pivotally mounted in brackets 30 secured to the inner walls of the recesses 14 and 16. The levers 18 and 24 are coloured red, the levers 20 and 26 are coloured yellow and the levers 22 and 29 are coloured green. The levers 18, 20, 22 and 24, 26, 28 each carry a lever arm 18A, 20A, 22A, 24A, 26A and 28A respectively, each lever arm having a projecting portion 18B, 20B, 22B, 26B and 28B respectively, the projecting portion on lever arm 24A not being visible in the drawings. Projections 20C, 24C, 26C, and 28C are also provided on the respective lever arms (those on arms 18A and 22A not being visible) to limit the movement of the lever arms as will be hereinafter explained.

Beneath the playing area 4 is an electrical circuit which comprises electrically conductive metal strips 30 and 32 which when the levers are in their stable positions — as the lever 20 in FIG. 3 — are not in electrical contact, and which when two of the opposing levers are depressed as lever 26 in FIG. 3 — are in electrical contact, as will be later explained. A bulb 34 housed in a housing 36 is electrically connectable to the strips 30 and 32 by suitable wiring (not shown) and to a power source such as batteries 38 again by wiring, not shown in the drawings. The batteries are located in a casing 40 having the appropriate electrical spring contact arms 42 and 44.

Although not shown in the drawings, the game board may be provided with a bottom panel to enclose the lever areas and the electrics, or alternatively a bottom panel may be provided to the housing 36 and the casing 40 if preferred.

The game board will preferably be composed of a rigid or semi-rigid synthetic plastics material which will be non-transparent so as to conceal the movable lever arms and the electrics.

Figure 5:
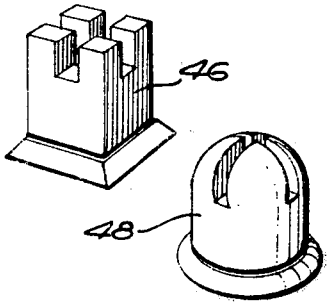
FIG. 5 is a perspective view of playing pieces forming part of the apparatus of the invention.

Also forming part of the apparatus according to the invention is a dice (not shown) and two sets of playing pieces 46 and 48 (FIG. 5) each set consisting of three playing pieces identical in shape but of colours red, yellow and green.

In playing the game, the three playing pieces of each set are placed on the centre three "base" playing positions 8A, 8B, 8C, and 10A, 10B, and 10C so that the colours of the playing pieces are in line with the coloured members 12A, 12B and 12C. A dice (not shown) is then thrown to determine the number of playing positions to be moved and decides which of his coloured playing pieces he will move. In so deciding, he depresses the corresponding lever 18, 20 or 22 and keeps the lever depressed, so moving the inner end of the corresponding lever arm to move from beneath the respective member 12A, 12B or 12C, so that when the bulb is illuminated light therefrom will "illuminate" the member 12A, 12B or 12C. However, the circuit to illuminate the bulb will not be completed until one of the opponents levers is depressed. The second player or opponent then has to try and guess which lever the first player has depressed, i.e. which colour has been chosen and he depresses the corresponding lever on his side of the game board. If, for example, the second player believes that the first player has chosen to move his red playing piece and has therefore depressed lever 18, the second player will depress his red lever 24 and in so doing the electrical circuit will be completed and the bulb will illuminate. If the second player has chosen correctly, then the two red members 12A will be illuminated and the first player does not move his playing piece, and the procedure is repeated, the second player having first choice this time. If however the second player has chosen incorrectly so that two different coloured members 12A, 12B or 12C are illuminated, then the first player may move his playing piece the number of playing positions indicated on the previously thrown dice.

The playing piece to be moved is thus moved forwardly away from its bare square. The playing piece may be moved forwards, backwards (except from the bare square) and to either side, but they cannot move onto the area 6A. The playing pieces can change direction any number of times, but they cannot move diagonally and they cannot jump over other playing pieces. When the first player has moved his playing piece, the second player has his turn and the game proceeds accordingly, the winner being the first player to get two of his three playing pieces to the opponents side of the game board or onto the opponents "base" squares.

Figure 6:
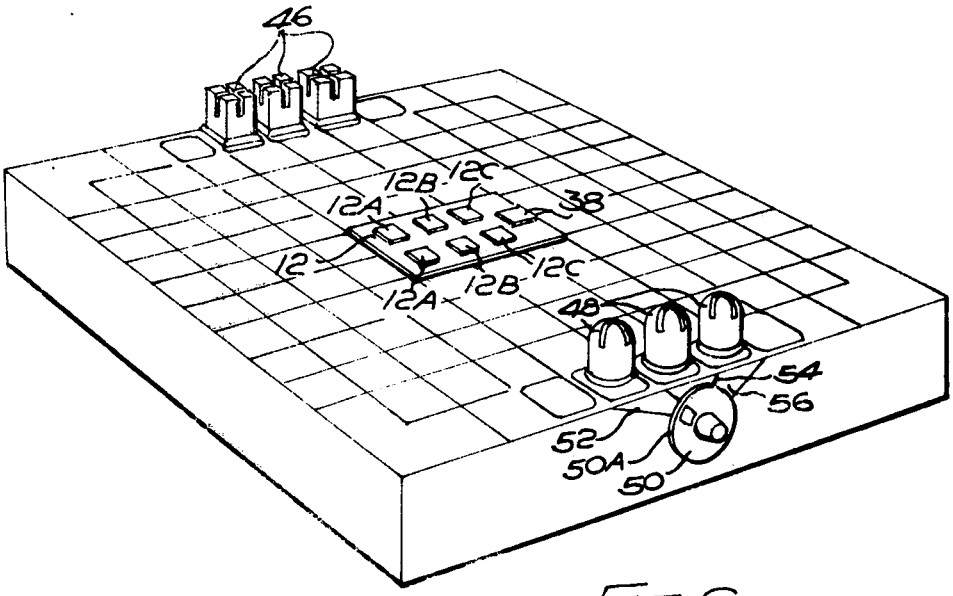
FIG. 6 shows an alternative arrangement of the invention.

In an alternative arrangement of the invention, the game board may be arranged as in FIG. 6, wherein the board is substantially the same, except that the mode of illumination and colour selection is different. In this case a single selector knob or dial 50 is located at opposed sides of the game board 2, the selector knob having a cut-out 50A which can be turned so that one of the colours red, yellow or green is visible therethrough, there colours being indicated on the three areas 52, 54 56 on the sides of the game board 2.

To illuminate the members 12A, 12B, 12C a button 58 is depressed to complete the electrical circuit.

Play is as described before.

The arrangement of the invention as shown in FIG. 6 is much simpler than the first described embodiment since the somewhat complicated levers and lever arms are eliminated.

It will be appreciated that the colours may be other than these described, and that the playing pieces may be more-or-less than three and of any desired shape such as in the shape of tanks, ships etc etc.

What we claim is:

1. Apparatus for playing a game comprising in combination a game board having a playing area comprising a plurality of playing positions arranged in regular array, and sets of opposed playing pieces adapted to be moved within said playing area on said playing positions, said playing area including opposed starting/finishing positions and including indicating means which are adapted, upon actuation of operating means connected thereto, to indicate whether a playing piece may move within said playing area, and determining means to determine the number of playing positions to be moved by a playing piece, said indicating means being a plurality of members arranged in pairs, said members being illuminable upon actuation of said operating means.

2. Apparatus according to claim 1 wherein said operating means consist of rotatable dials located at opposing sides of the game board, said dials each having a cut-out to indicate which of the members are to be illuminated.

3. Apparatus according to claim 1, wherein said sets of playing pieces are visually different from each other.

4. Apparatus according to claim 1 wherein said pairs of members are of differing colours and are composed of transparent or translucent material.

5. Apparatus according to claim 1 wherein there are two pluralities of operating means in opposed relationship at opposing sides of the game board, said operating means being movable in a first direction to cause illumination of said members by means of an electric light bulb located beneath said members.

6. Apparatus according to claim 5, wherein said pluralities of operating means are located in recesses at opposite sides of the game board, each of said operating means consisting of a lever and lever arm which upon movement of said first direction are adapted to cause illumination of said electric light bulb.

* * * * *